US005906509A

United States Patent [19]

Wu

[11] Patent Number: 5,906,509

[45] Date of Patent: May 25, 1999

[54] CHARGER WITH A REPLACEABLE ELECTRICAL PLUG

[75] Inventor: Michael Wu, Taipei Hsien, Taiwan

[73] Assignee: Formosa Electronic Industries, Inc., Taipei Hsien, Taiwan

[21] Appl. No.: 08/841,617

[22] Filed: Apr. 30, 1997

Related U.S. Application Data

[63] Continuation-in-part of application No. 08/767,410, Dec. 16, 1996, Pat. No. 5,829,993.

[51] Int. Cl.[6] ..... H01R 29/00

[52] U.S. Cl. ..... 439/518

[58] Field of Search ..... 439/131, 170, 439/171, 172, 518

[56] References Cited

U.S. PATENT DOCUMENTS 5,613,863 3/1997 Klaus et al. ..... 439/131
5,713,749 2/1998 Wu ..... 439/131

*Primary Examiner*—Neil Abrams
*Attorney, Agent, or Firm*—Smith, Gambell & Russell, LLP; Beveridge, DeGrandi, Weilacher & Young; Intellectual Property Group

[57] ABSTRACT

A charger with replaceable electrical plugs includes a casing 1 comprising a lower casing 11 and an upper casing 12. An electronic power supply circuit 13 is accommodated inside the casing 1. The lower casing 11 has an opening 111 having a replaceable electrical plug 14 pivotally disposed therein to adapt to different specifications of electrical sockets used in different countries. The power supply circuit 13 may convert ac into low voltage dc for use by small electrical appliances. The upper housing 12 is provided with a tubular recess 122 pivotally provided with a cigarette lighter plug 15 which may fit into a car's cigarette lighter socket. The power supply circuit 13 may transform the car's high voltage dc into low voltage dc to provide electric power outdoors. Different replaceable electrical plugs 14 and 14' allow the charger device to be adapted for use in various different countries, which use various different power outlet structures.

4 Claims, 16 Drawing Sheets

CHARGER WITH A REPLACEABLE ELECTRICAL PLUG

This application is a continuation-in-part of U.S. patent appln. Ser. No. 08/767,410, filed Dec. 16, 1996, now U.S. Pat. No. 5,829,993 (issued Nov. 3, 1998).

BACKGROUND OF THE INVENTION (a) Field of the Invention

The present invention relates generally to a charger, and more particularly to a charger with a replaceable electrical plug for matching the different specifications of electrical sockets adopted in different countries, the casing of the charger being further provided with a cigarette lighter plug for utilizing the electric power of cars when outdoors.

(b) Description of the Prior Art

Portable electrical appliances such as mobile phones, electric shavers, and walkmans have their specific rechargeable batteries or concealed batteries. They are generally used with specific chargers. For travelers, when the power of their batteries is used up, it is often times difficult to directly utilize local electric power to recharge the batteries due to different specifications of electric sockets.

Furthermore, since the standard voltages vary from country to country, even if the travelers have the right type of electrical plugs, the difference in standard voltages may make it impossible to directly utilize the local electric power in recharging. If the output dc voltage is too high, it will damage the electrical appliance. If the voltage is too low, the electrical appliance will not function.

In addition, although some electrical appliances are equipped with chargers or electric plugs to match the specifications of electric sockets or standard voltages of specific countries, generally, they are restricted to larger appliances. Besides, it is unfeasible if not impossible to have various chargers to adapt to the standard voltages of countries around the world for people who travel to various countries.

Moreover, even though some countries may adopt the same standard voltage, the specifications of the electrical sockets are different. It is therefore only necessary to provide a matching connector. However, such connectors are generally large in size and are therefore not suitable for travelers.

As mentioned above, travelers generally use mobile phones. The battery compartment of the mobile phone can store limited electric power and frequent replacement is necessary. For travelers, it is therefore necessary to recharge the batteries when stopping at a hotel. But, as described above, if the right electrical plug is not available or the standard voltage is different, the charger will have no use.

Furthermore, ordinary chargers can convert ac into low voltage dc. In other words, they can only be used indoors. Chargers for utilizing outdoor electric power are not available. Although cars are provided with specific electric plugs and transformers for small electrical appliances, it is necessary to carry a different charger, which is very inconvenient, especially to traveling businessmen.

In consideration of the above-described problems, the inventor of the present invention has conceived a charger with a replaceable electrical plug for matching different specifications of electrical sockets adopted in different countries. The charger is provided with an electronic power supply circuit for converting the standard voltages of different countries into a dc voltage for use by small electrical appliances. The charger may also utilize the electric power of cars when outdoors. According to the present invention, the charger essentially comprises a casing comprised of a lower casing and an upper casing. The lower casing has an opening accommodating an inner casing, which in turn has mounted therein two electrically conductive pieces connected to an electronic power supply circuit. The inner casing is provided with a slide seat with a spring disposed between the inner casing and the slide seat. Both sides of the inner casing are respectively provided with a curved notch, while both sides of the slide seat are respectively provided with a half pivot seat. Both sides of the opening are also respectively provided with a curved pivot seat. The half pivot seats, the curved notches and curved pivot seats together form two pivot holes for mounting thereon a replaceable electrical plug. The electrical plug has a contact terminal which may contact the conductive pieces when the plug is turned outwardly. The slide seat may be pushed so that the half pivot seats may separate from the curved notches and curved pivot seats to allow removal of the electrical plug from the pivot holes. The upper casing is pivotally connected to a cigarette lighter plug whereby the electronic power supply circuit may convert a car's high voltage dc into low voltage dc for use by small electrical appliances.

SUMMARY OF THE INVENTION

Accordingly, a primary object of the present invention is to provide a charger with a replaceable electrical plug which may match different specifications of electrical sockets adopted in different countries and which may convert the local standard voltage of any country into a dc voltage for use by small electrical appliances.

Another object of the present invention is to provide a charger with a replaceable electrical plug wherein the charger has a casing pivotally provided with a cigarette lighter plug for converting a car's high voltage dc into low voltage dc for use by small electrical appliances when outdoors.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
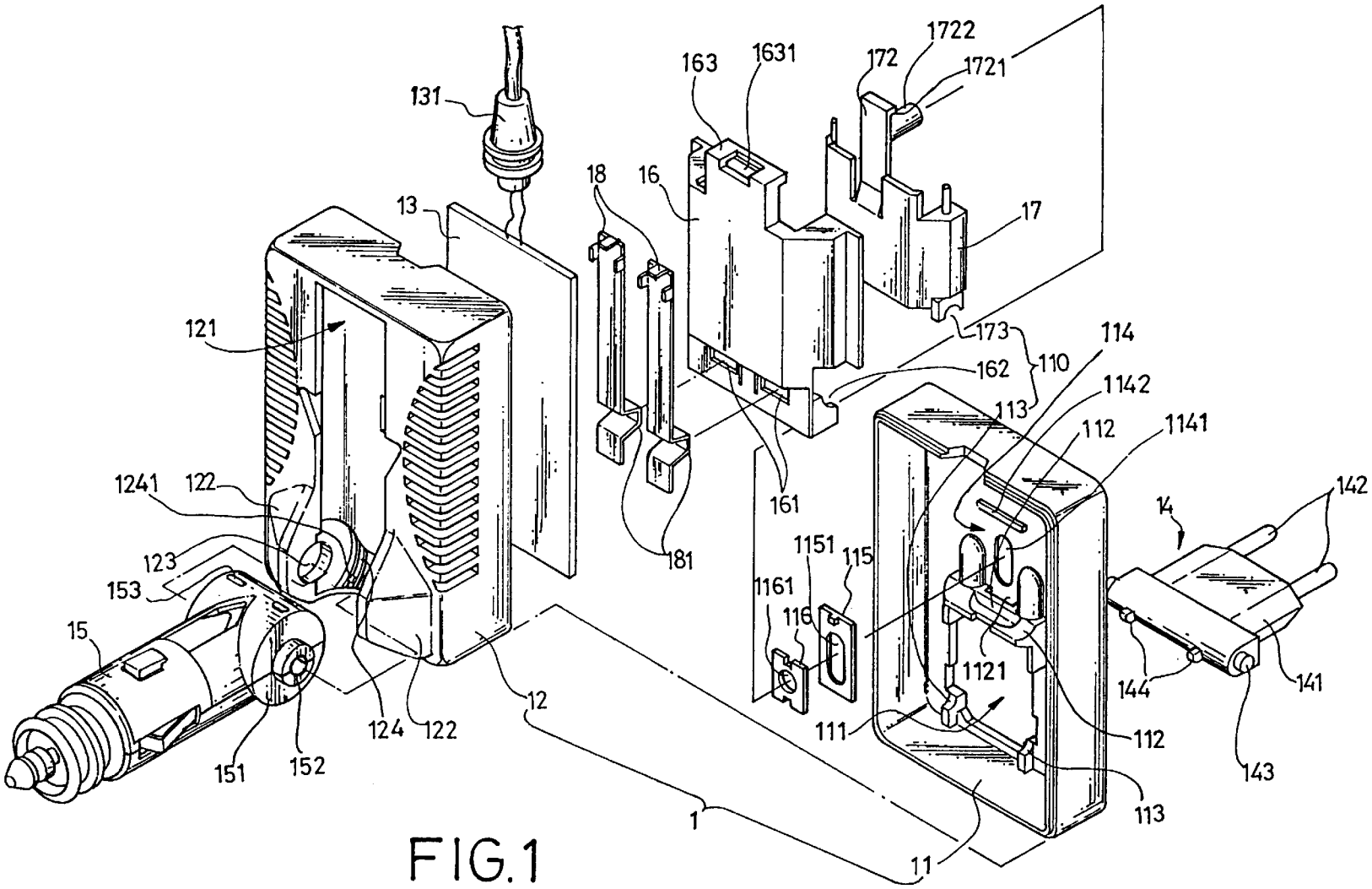
FIG. 1 is an elevational exploded view of the present invention.
Figure 2:
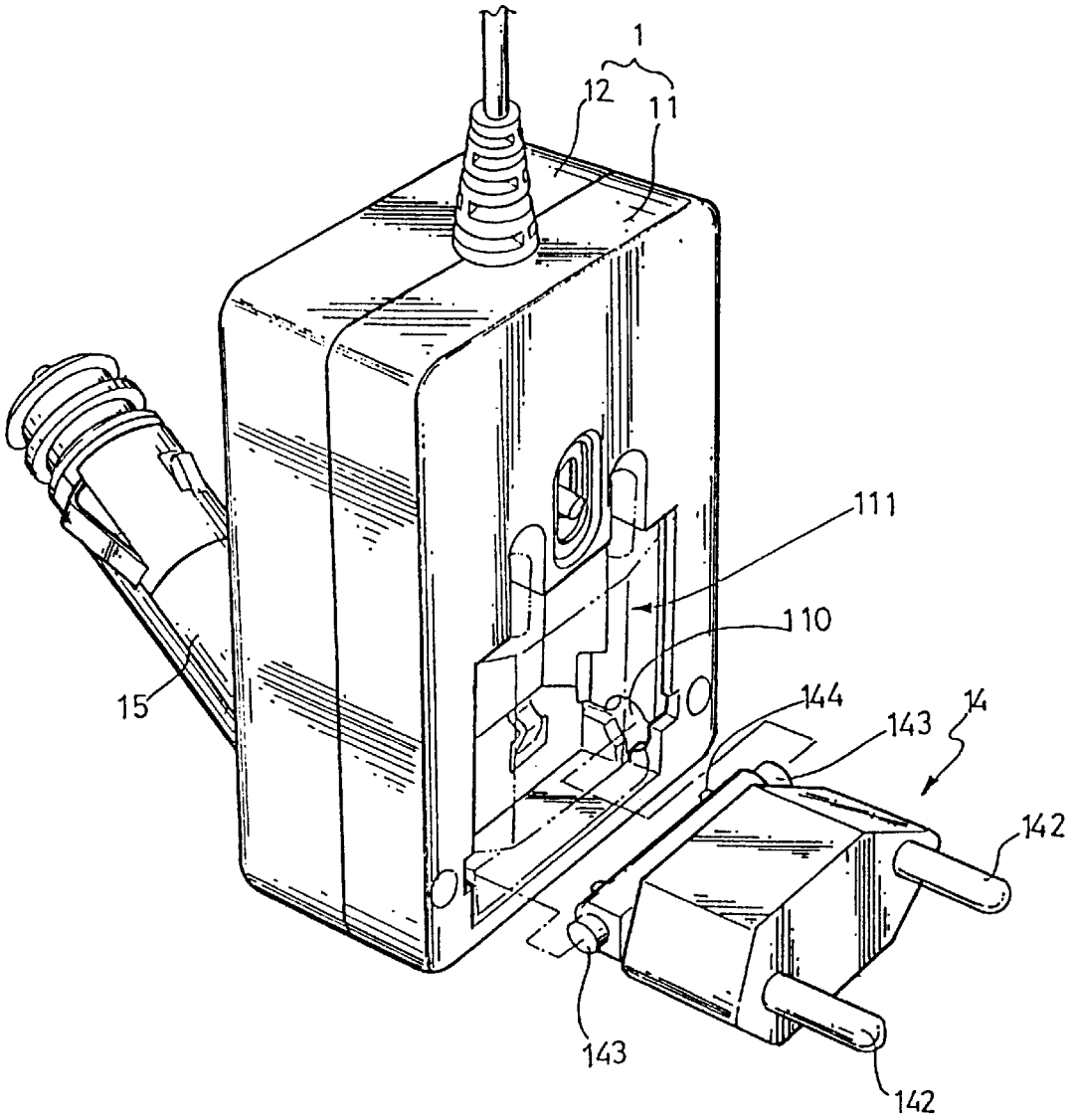
FIG. 2 is an elevational view of the present invention.

With reference to FIGS. 1 and 2, the present invention essentially comprises a casing 1 comprised of a lower casing 11 and an upper casing 12, an electronic power supply circuit 13 being accommodated therein for lowering dc voltage and converting ac voltage. The housing 1 may match a plurality of replaceable electric plugs 14. A suitable replaceable electrical plug 14 may be mounted in the lower casing 11 so that the casing 1 may match different types of electric sockets adopted in different countries. The upper casing 12 has a cigarette lighter plug 15 pivotally provided thereon so that the casing 1 may be plugged into a car's cigarette lighter socket (not shown) to utilize the car's electric energy. The structure and relationship of the structural elements will now be described in detail hereinbelow.

The lower casing 11 is provided with an opening 111 at a suitable position, a projecting seat 112 at a rear edge inside the opening 111. The projecting seat 112 is provided with a rectangular hole 1121 thereon. A slide groove 114 is provided inside the lower casing 11 to the rear of the projecting seat 112. The slide groove 114 is provided with an elongated slot 1141 therein, a stop block 1142 being provided behind the slide groove 114. A movable fastening piece 115 and a positioning slide piece 116 are mounted above the slide groove 114. The movable fastening piece 115 is provided with an elongated hole 1151, and the positioning slide piece 116 is provided with a circular hole 1161. The movable fastening piece 115 is inserted into the rectangular hole 1121 of the projecting seat 112. Each end of a front edge inside the opening 111 is provided a curved pivot seat 113. Inside the lower casing 11 and corresponding to the opening 111 is secured an inner casing 16. The surface of the front end of the inner casing 16 is provided with two slots 161. Each side wall of the front end of the inner casing 16 includes a curved notch 162. A fastening seat 163 is further protrudently disposed at the middle of the rear end of the inner casing 16, with a fastening hole 1631 disposed thereon.

A slide seat 17 is fitted inside the inner casing 16 of the lower casing 11 such that it may reciprocate therein. An elastic fastening piece 172 is protrudently disposed at the middle of the rear end of the slide seat 17. The elastic fastening piece 172 has a protrudent block 1721 thereon, and a circular rod 1722 fitted thereon. The circular rod 1722 may be inserted into the elongated hole 1151 of the movable fastening piece 115 and the circular hole 1161 of the positioning slide piece 116, as well as the elongated slot 1141 of the lower casing 11, such that, by means of pushing the circular rod 1722 inwardly to press the slide seat 17, the protrudent block 1721 of the elastic fastening piece 172 may engage the fastening hole 1631 of the inner casing 16, causing the movable fastening piece 115 to extend outwardly to retract with the movement of the slide seat 17. Each lateral side of the front end of the slide seat 17 is provided with a half pivot seat 173 which may form a pivot hole 110 with the curved pivot seat 113 of the lower casing 11 and the curved notch 162 of the inner casing 16.

Two electrically conductive pieces 18 are disposed at the bottom of the inner casing 16. Each conductive piece 18 has a bent portion 181 at the front end for matching the slot 161 of the inner casing 16. The rear end thereof is connected to the electronic power supply circuit 13.

The replaceable electrical plug 14 includes a plastic plug body 141 with a plurality of electrically conductive legs 142 for matching an electric socket. Both sides of the rear end of the plug body 141 are respectively provided with a protrudent pivot 143 which may fit into the pivot hole 110 formed by the half pivot seat 173 of the slide seat 17, the curved pivot seat 113 of the lower casing 11 and the curved notch 162 of the inner casing 16. The legs 142 extend rearwardly to have two contact terminals 144 projecting from the rear edge of the plug body 141 such that the contact terminals 144 may contact the bent portions 181 of the two conductive pieces 18 when the plug 14 is turned outwardly after assembly.

The upper casing 12 is provided with a tubular recess 121 at a suitable position. Below the recess 121 is disposed a pair of pivot seats 122 each being provided with a pivot hole 123. A plurality of elastic arms 124 are further disposed in the recess 121 at suitable positions. Each elastic arm has a boss 1241. The above-mentioned cigarette lighter plug 15 may be pivotally provided on the pivot seats 122. The bottom side of the cigarette lighter plug 15 is provided with a cylindrical element 151 having a short pivot 152 provided at either side thereof and a plurality of depressions 153 on its peripheral surface. The short pivots 152 may fit into the pivot holes 123 of the pivot seats 122 so that the cigarette lighter plug 15 may be pivotally mounted on the pivot seats 122 of the upper casing 12, and the bosses 1241 in the recess 121 may engage the depressions 153 of the cylindrical element 151.

Figure 3:
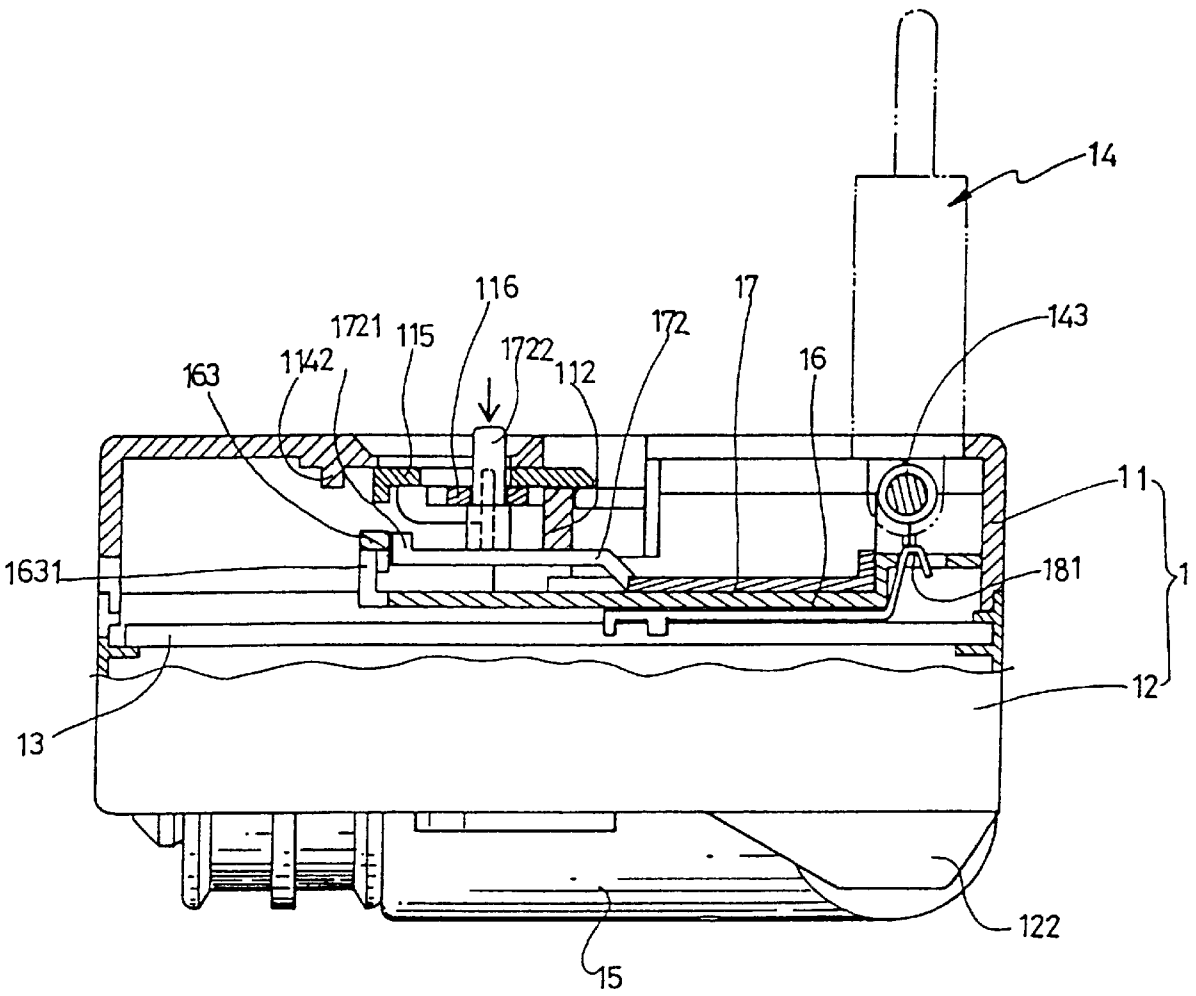
FIG. 3 is a sectional view of a replaceable electrical plug according to the present invention.

In practice, referring also to FIG. 3, the protrudent pivots 143 at both sides of the plug body 141 of the electrical plug 14 are pivotally mounted in the pivot holes 110 formed by the half pivot seats 173 of the slide seat 17, the curved pivot seats 113 of the lower casing 11 and the curved notches 162 of the inner casing 16. Since the lower casing 11 has the opening 111, the electrical plug 14 may turned inwardly to be stored within the casing 1. Furthermore, when the electrical plug 14 is turned outwardly, the contact terminals 144 thereof will contact the conductive pieces 18. Therefore, ac current may flow via the legs 142 of the electrical plug 14 through the conductive pieces 18 to the power supply circuit 13 which converts it into dc current. The electronic power supply circuit 13 may convert the standard voltages of different countries into dc current required by small portable electrical appliances.

Figure 4:
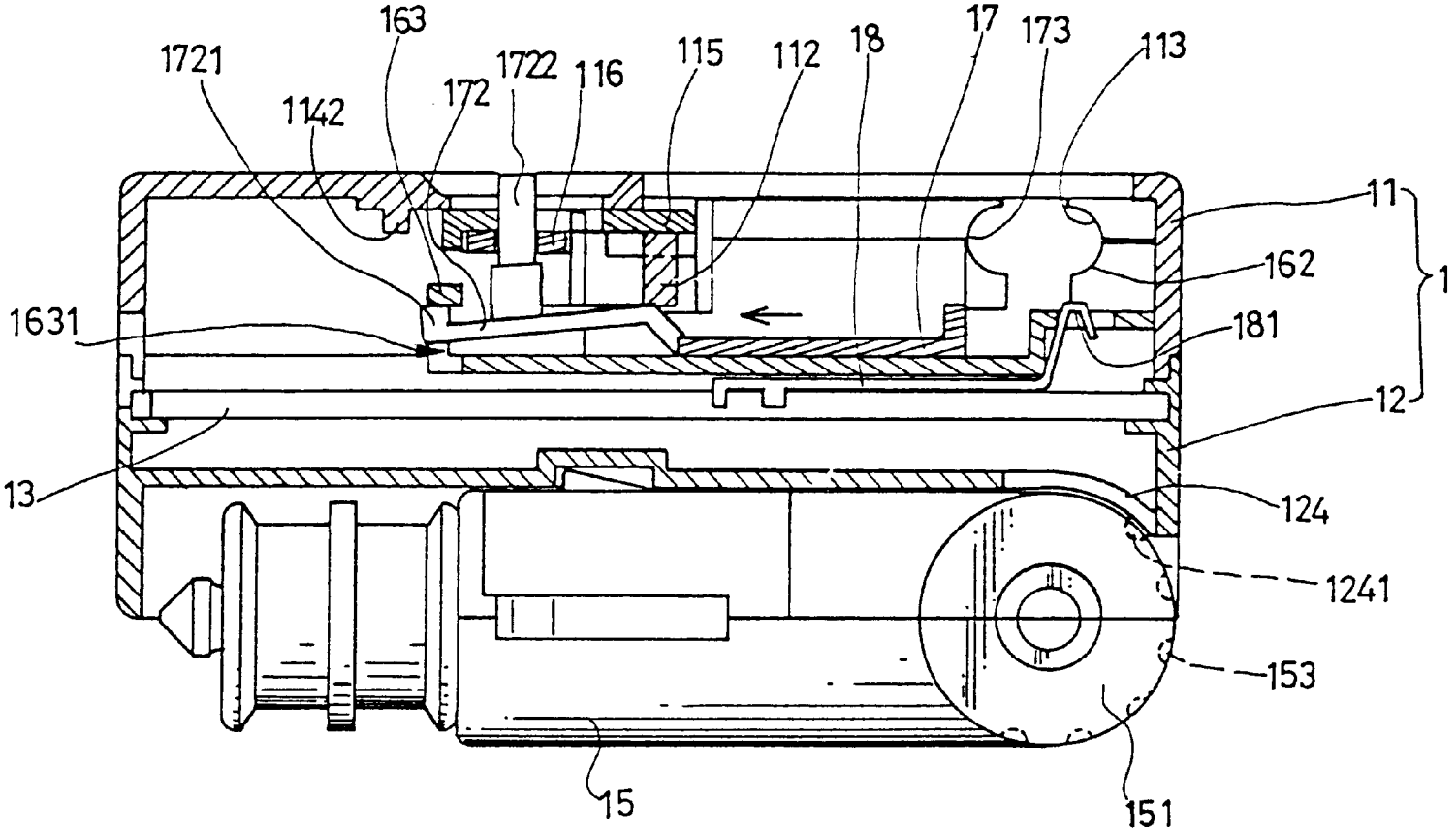
FIG. 4 is a sectional view illustrating the half opening state of the slide seat according to the present invention.

Furthermore, since the specifications of the electrical sockets vary from country to country, various electrical plugs 14 designed in different specifications may be used. In replacing the electrical plug 14, the electrical plug 14 is turned outwardly and the circular rod 1722 on the elastic fastening piece 172 of the slide seat 17 is pushed so that the slide seat 17 slidably displaces inwardly, hence the half pivot seats 173 on the slide seat 17 disengage from the curved notches 162 of the inner casing 16 and the curved pivot seats 113 of the lower casing 11 to release the pivots 143 at both sides of the electrical plug 14, as shown in FIG. 4. The electrical plug 14 may then be removed, and a suitable one may be connected to the casing 1 in the following manner. Firstly, the pivots 143 at both sides of the electrical plug 14 are rested on the curved notches 162 at both sides of the inner casing 16. Then, by pressing the circular rod 1722 of the slide seat 17 to push the slide seat 17 inwardly, the half pivot seats 173 rest on the protrudent pivots 143 and fit with the curved notches 162 and the curved pivot seats 113. Then the upper end of the elastic fastening piece 172 of the slide seat 17 abuts the lower side of the fastening seat 163 of the inner casing 16 to position the slide seat 17 so that the electrical plug 14 may be pivotally positioned in the pivot holes 110 thus formed, as shown in FIG. 3. Because the opening 111 of the lower casing 11 is configured to have a maximum size to fit all specifications of electrical plugs, any size of electrical plugs 14 may be swung rearwardly to be stored inside the casing 1 to save space and facilitate carrying and storage.

Figure 5:
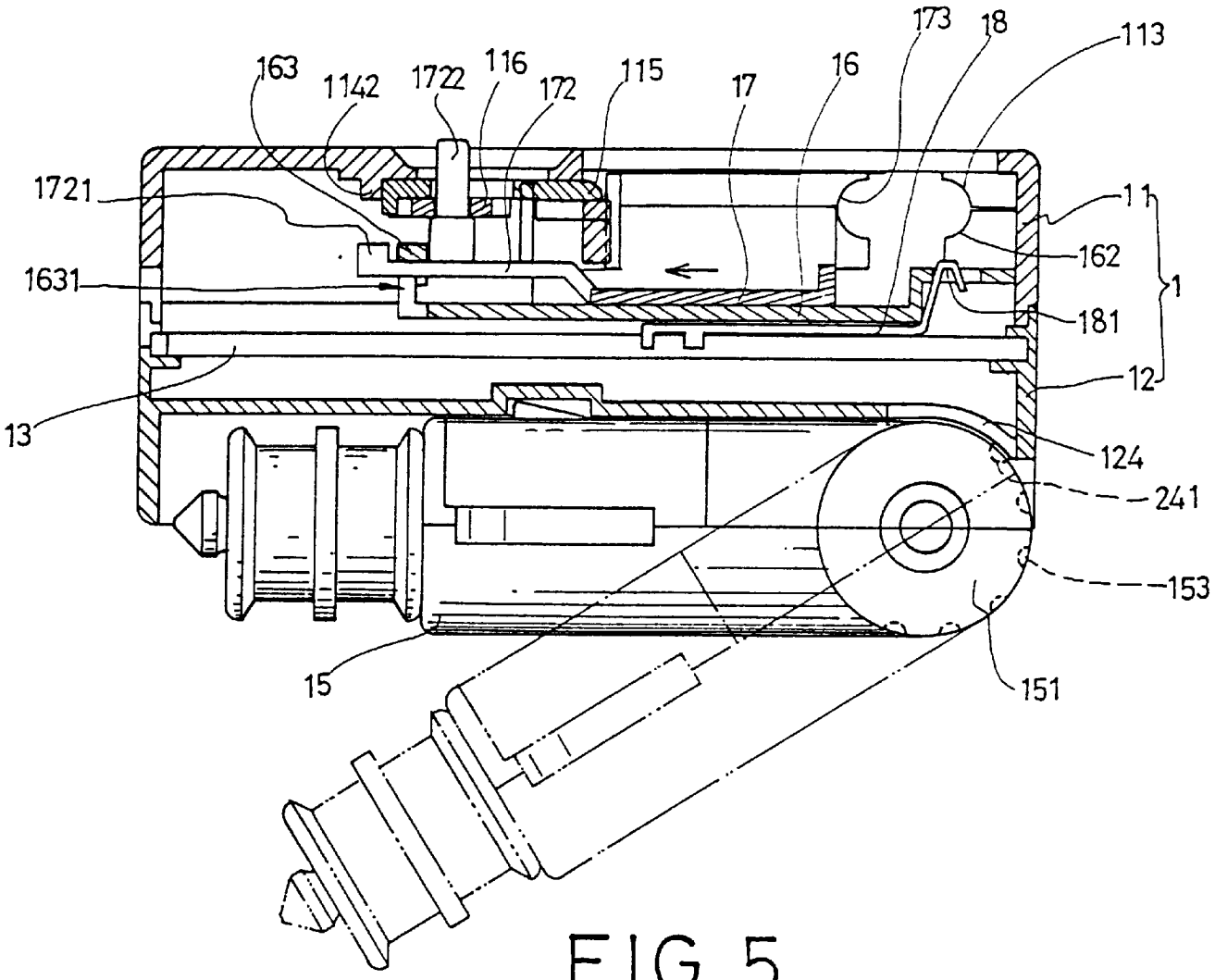
FIG. 5 illustrates the fully open state of the slide seat according to the present invention.
Figure 6:
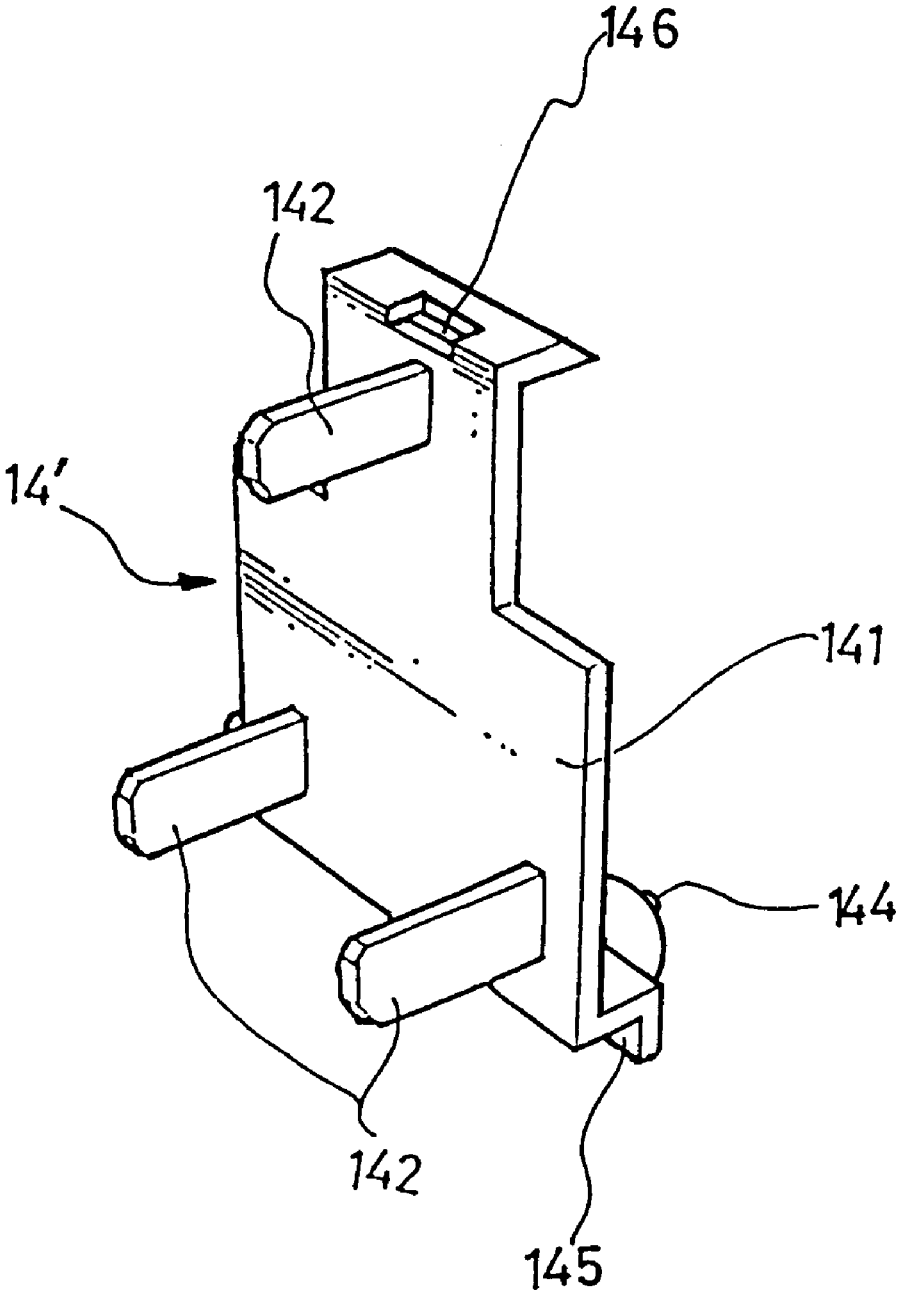
FIG. 6 is an elevational view of the replaceable electrical plug of another embodiment.
Figure 7:
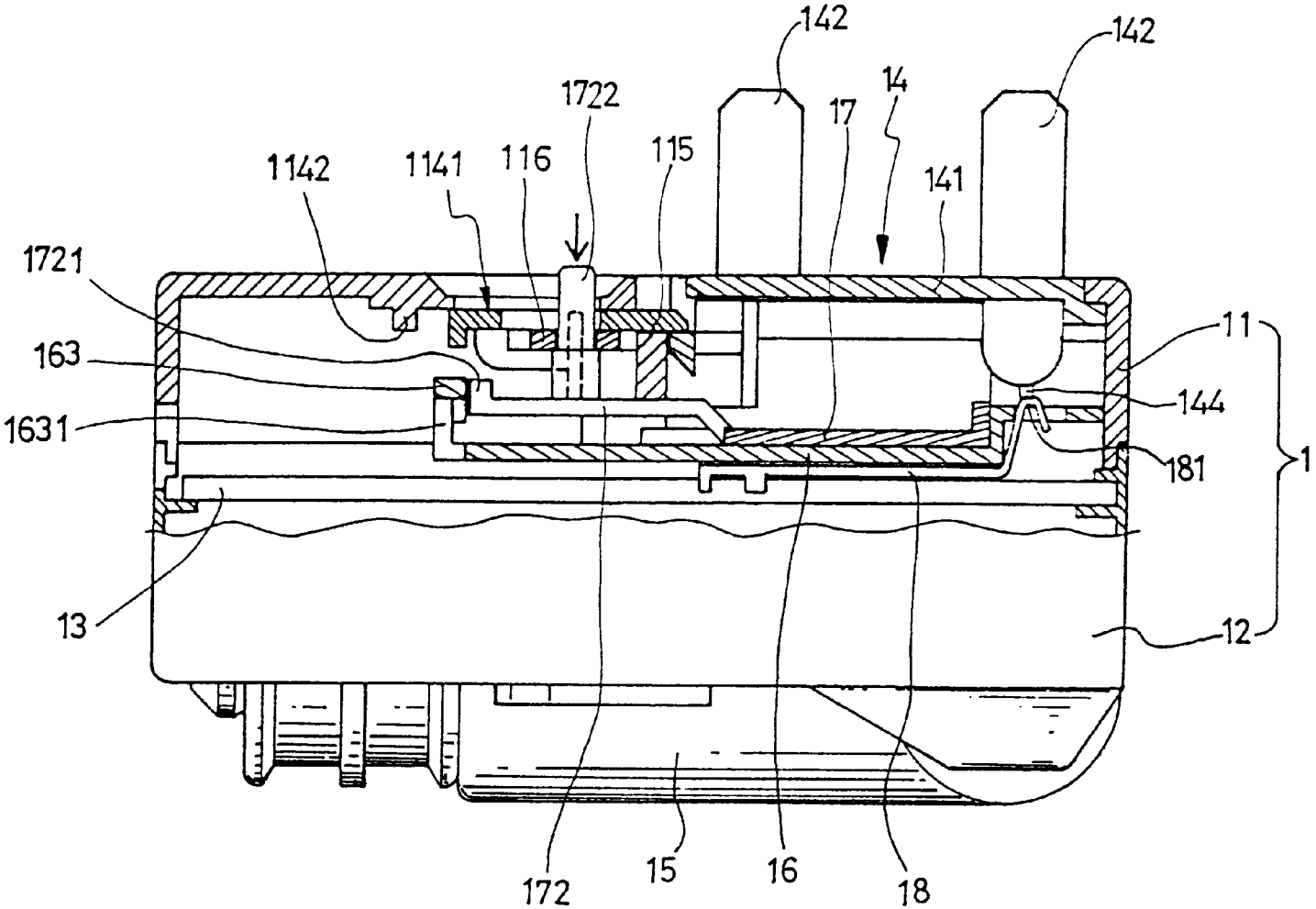
FIG. 7 is a sectional view of the electrical plug shown in FIG. 6.

With reference to FIGS. 5 and 6, the electrical plug 141 may be configured to have three electrically conductive legs 142 to match a three-hole electrical socket. The plug body 141 may be a plate-like structure provided with a protrudent piece 145 at its lower side. The upper side of the plug body 141 is provided with a positioning indentation 146. The protrudent piece 145 of the plug body 141 may be utilized to urge against the inner edge of the opening 111 of the lower casing 11 and, by pushing the circular rod 1722 of the slide seat, the slide seat 17 may displace outwardly. As the slide groove 114 of the lower casing 11 is provided with the movable fastening piece 115 and the positioning slide piece 116, and the circular rod 1722 of the slide seat 17 is fitted on the movable fastening piece 115 and the positioning slide piece 16, when the slide seat 17 displaces forwardly, the movable fastening piece 115 projects outwardly to engage the positioning indentation 146 at the upper side of the plug body 141. Additionally, two contact terminals 144 at the rear edge of the electrical plug 14 urge against the bent portions 181 of the two conductive pieces 18. In this way, the three-prong electrical plug 14 may be mounted in the opening 111 of the lower casing 11, as shown in FIG. 7. If a two-prong electrical plug 14 is used, since there is no need for fastening or positioning to facilitate plugging out thereof, the movable fastening piece 115 will not have any fastening function when using the two-prong electrical plug 14.

Furthermore, the length of the elongated hole 1151 of the movable fastening piece 115 is slightly smaller than that of the elongated slot 1141 of the lower casing 11, and the positioning slide piece 116 has only a circular hole 1161, and if the slide seat 17 is in a fastened state as shown in FIG. 3, the movable fastening piece 115 is in a projecting state. Therefore, when the slide seat 17 is pushed to displace, the positioning slide piece 116 will move with the slide seat 17 first, while the movable fastening piece 115 remains stationary. At this point, the slide seat 17 is at a first stage of half opening, and a two-prong electrical plug 14 may be replaced, as shown in FIG. 4. After the two-prong electrical plug 14 has been replaced, the slide seat 17 may be pushed back so that it is in a fastened state. If the slide seat 17 is being pushed further inwardly, the movable fastening piece 115 and the positioning slide piece 116 will synchronously displace inwardly so that the movable fastening piece 115 retracts. At this point, the slide seat 17 is in a second stage of fully opened, as shown in FIG. 5, so that a three-prong electrical plug 14 may be replaced. After replacement, the slide seat 17 is pushed outwardly completely so that it is surely fastened and the movable fastening piece 115 may be positioned in the positioning indentation 146 at the upper side of the electrical plug 14 to secure the electrical plug 14 in the opening 111 of the lower casing 11, as shown in FIG. 7.

Since the electrical plug 14 may be replaced easily, the present invention, used in conjunction therewith and the electronic power supply circuit 13, may be used to charge rechargeable batteries without any problems. And since the electrical plugs 14 are comprised of a plastic plug body 14 and two legs 142, they are compact in size and convenient to carry and store, giving traveling businessmen or tourists convenience to obtain electric power for using small portable electrical appliances.

In addition, the cable 131 of the outputs of the power supply circuit 13 may be connected to the charging means of a mobile phone or any other electrical appliances to provide power for recharging batteries.

Furthermore, as the cigarette lighter plug 15 on the upper casing 12 has depressions 153 on its circumference, and the bosses 1241 in the recess 121 may fit into the depressions 153, when the cigarette lighter plug 15 is turned, it may be positioned at any point due to the depressions 153 retaining the bosses 1241 of the recess 121, as shown in FIGS. 4 and 5. When not in use, the cigarette lighter plug 15 may be turned inwardly to be hidden in the recess 121 of the upper casing 12 to save space.

Therefore, when it is necessary to utilize dc outdoor, the cigarette lighter plug 15 may be turned outwardly to fit into a car's cigarette lighter socket (not shown) to use the electric power of the car. By means of the power supply circuit 13, the high voltage dc of the car may be converted into a low voltage dc suitable for common electrical appliances. Hence when the user needs low voltage dc, he/she may utilize the car's electric power by means of the cigarette lighter plug 15 mounted on the upper casing 12.

Figure 8:
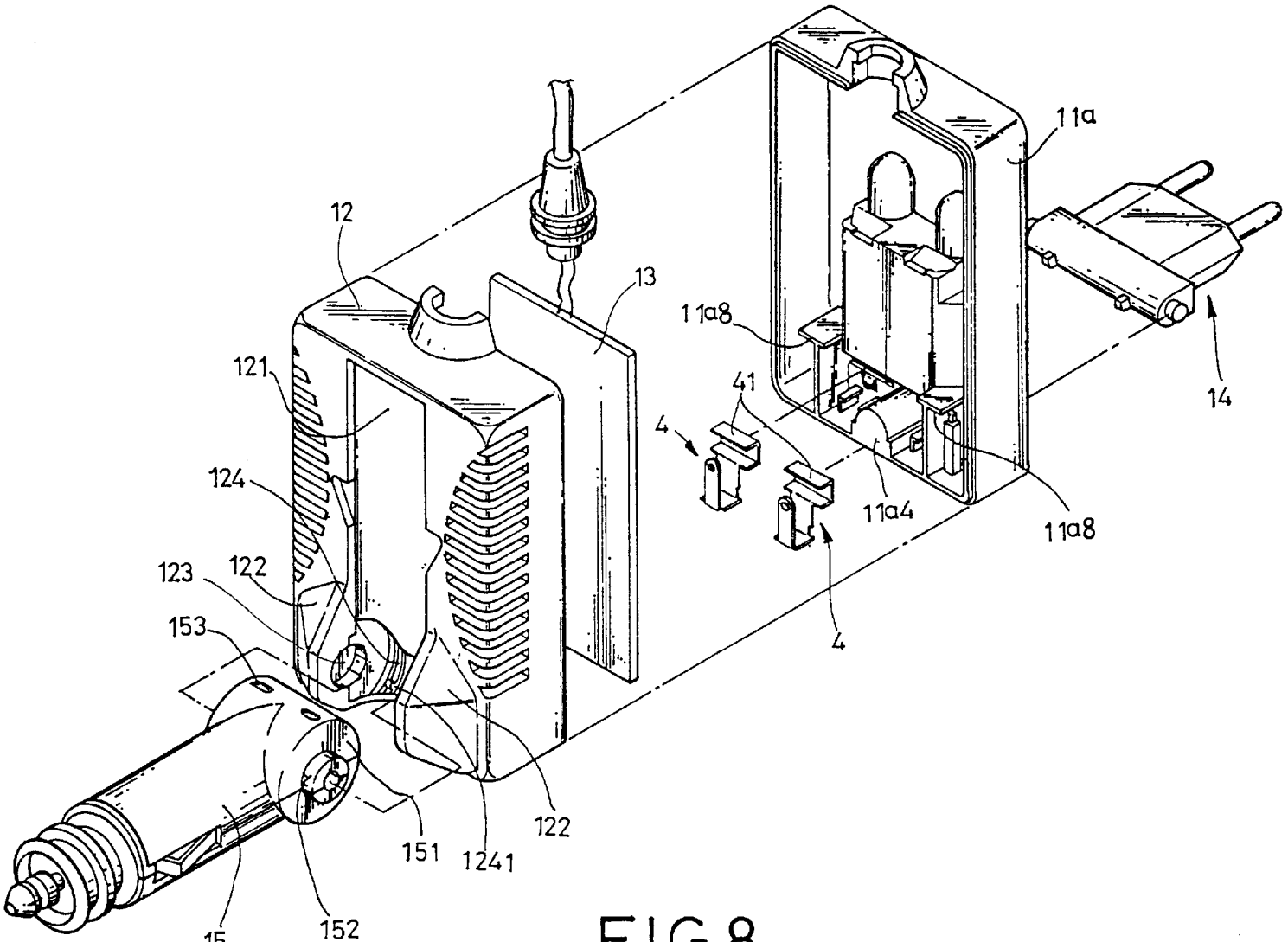
FIG. 8 is an elevational system diagram of another preferred embodiment of the present invention.
Figure 9:
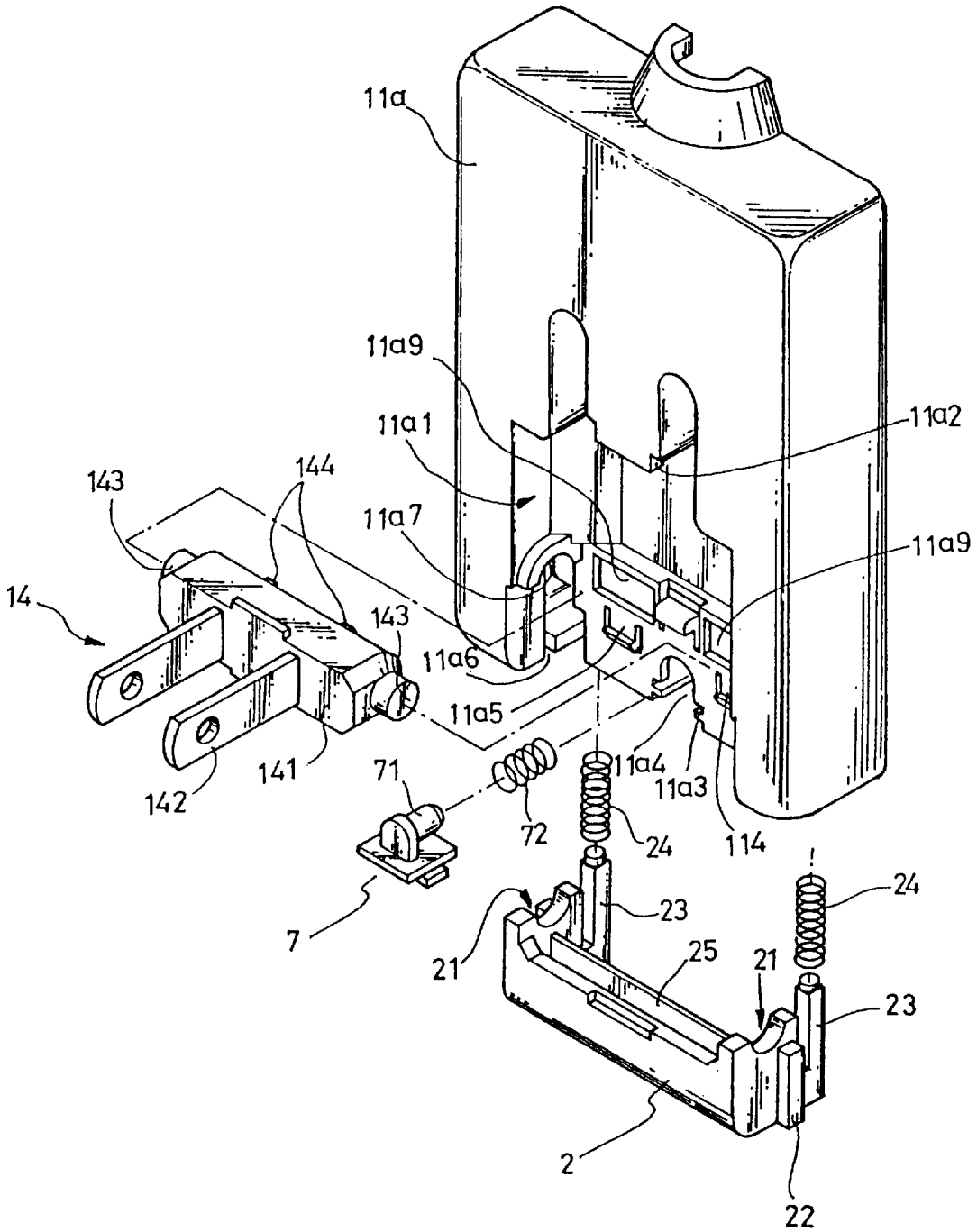
FIG. 9 is an elevational system diagram of the lower casing of the preferred embodiment of the present invention taken from a different angle.
Figure 10:
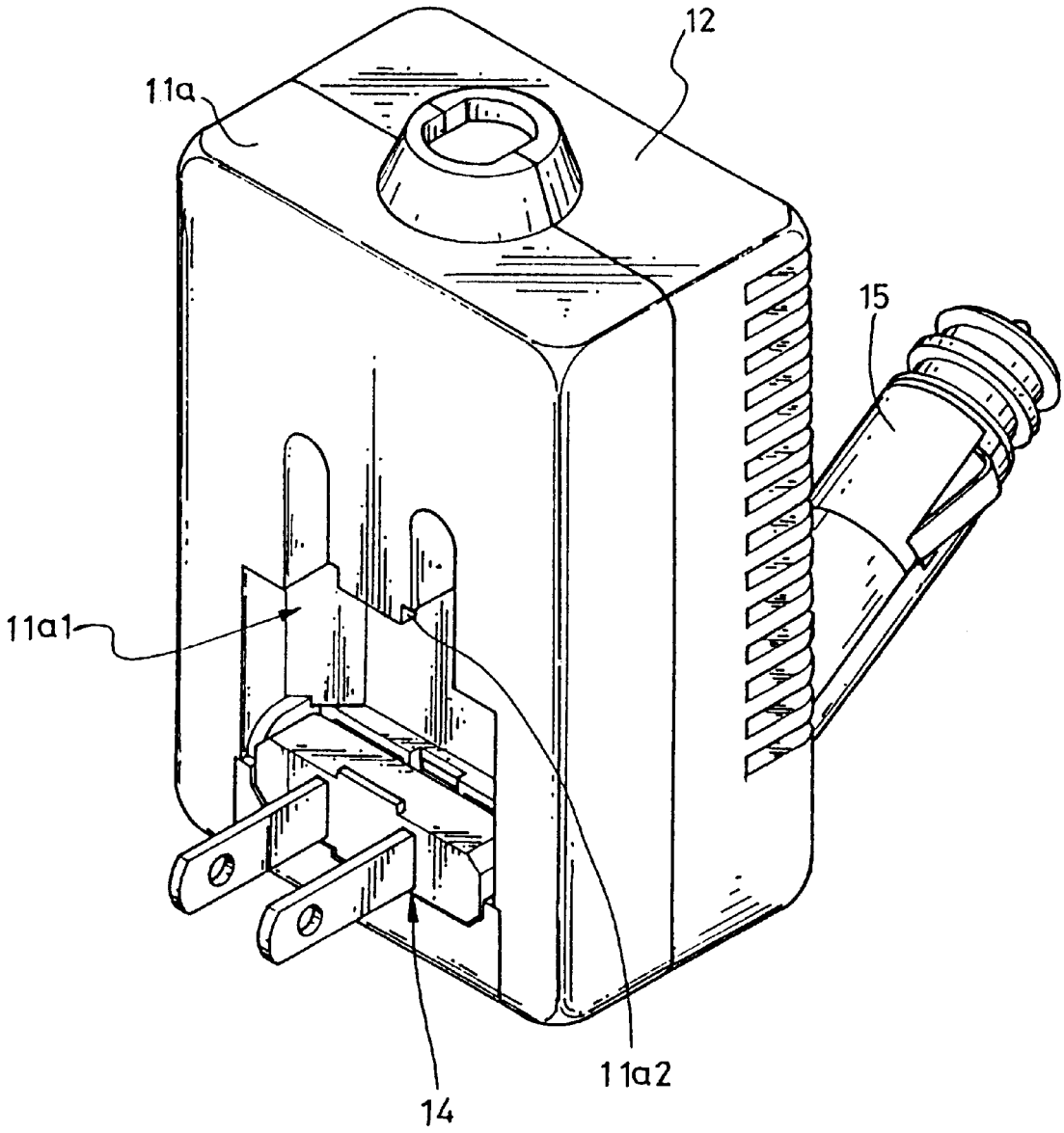
FIG. 10 is an elevational view of the preferred embodiment of the present invention.

Furthermore, reference is made to FIGS. 8, 9 and 10, showing another embodiment of the lower casing 11*a*, which is comprised of the lower casing 11*a* and a slide block 2.

The lower casing 11*a* has a plug socket 11*a*1 provided thereon. An inner lateral side of the plug socket 11*a*1 is provided with a projecting piece 11*a*2. The middle of an outer lateral side thereof is provided with a slide groove 11*a*3, and a slot 11*a*4 is provided at an inner lateral side of the slide groove 11*a*3. A plurality of resilient hooking plates 11*a*5 are provided at the outer lateral side of the plug socket 11*a*1 at suitable positions. Two guide slots 11*a*6 are respectively disposed at both sides of the outer lateral side of the plug socket 11*a*1, while a semi-circular slot 11*a*7 is disposed at each side of the plug socket 11*a*1 at a suitable position. A plurality of stop blocks 11*a*8 are provided at the inner lateral side of the lower casing 11*a*9. Two mounting slots 11*a* are provided at the plug socket 11*a*1 for receiving a respective conductive terminal 4. Each conductive terminal 4 has a front end with a bent portion 41 and a rear end connected to the electronic power supply circuit 13.

Figure 11:
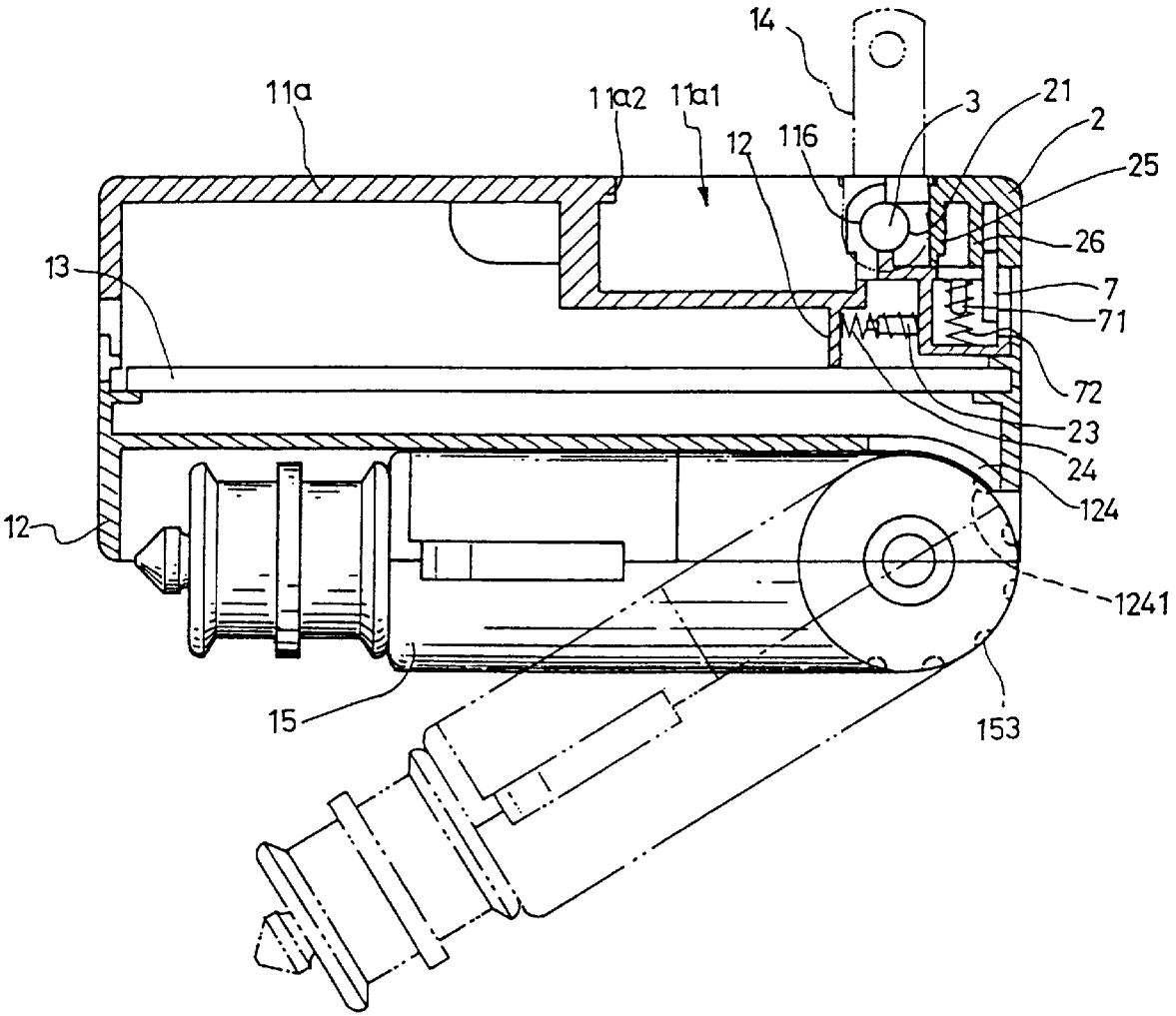
FIG. 11 is a sectional view of the electrical plug of the preferred embodiment of the present invention.
Figure 12:
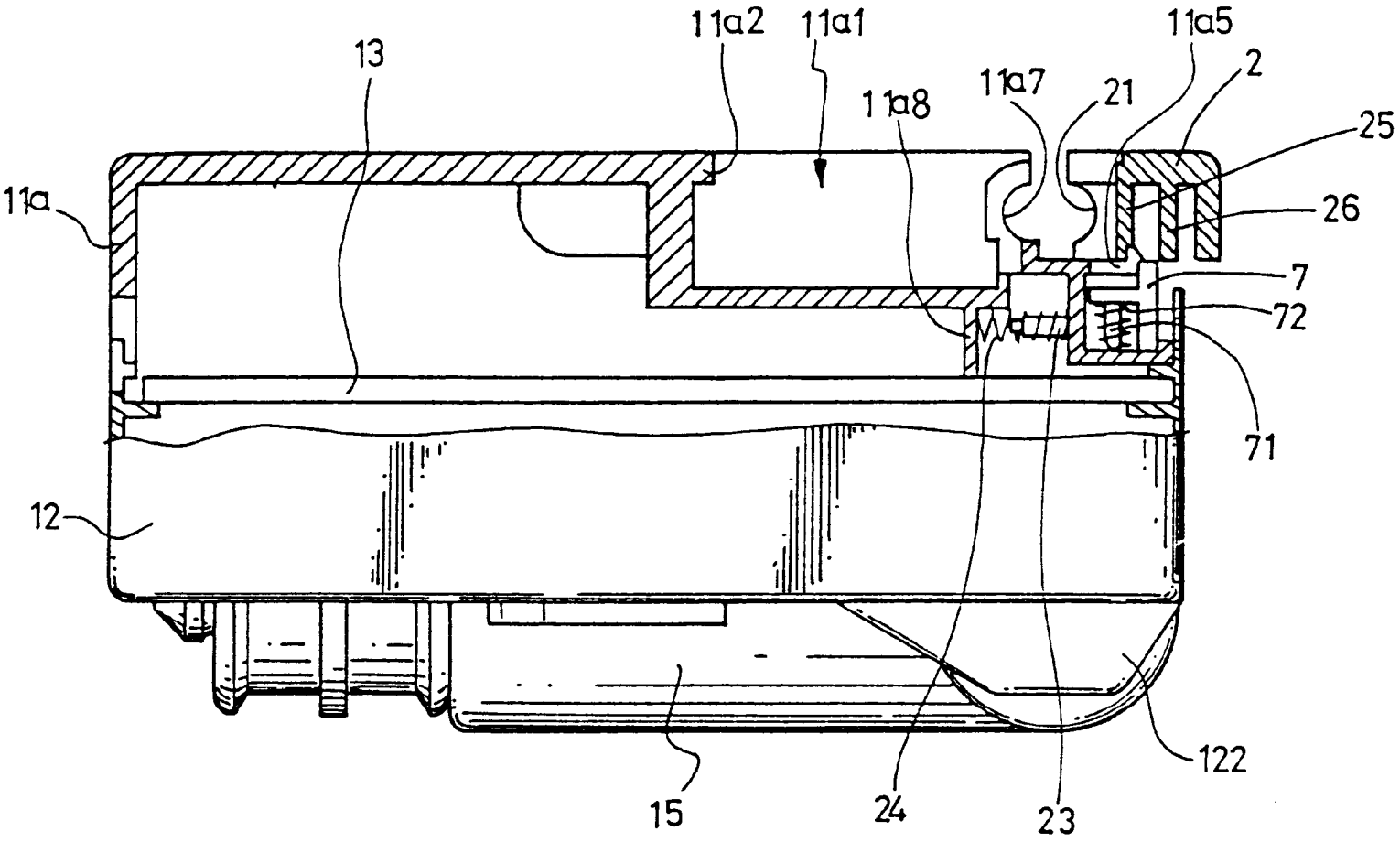
FIG. 12 is a sectional view illustrating the action of the slide seat according to the preferred embodiment of the present invention.

The slide block 2 is fitted at the outer lateral side of the plug socket 11*a*1. Both sides of a front end of the slide block 2 are provided with half pivot seats 21 corresponding to the semi-circular slots 11*a*7. Both sides of the slide block 2 are provided with guide blocks 22, which may fit into the guide slots 11*a*6 at both sides of the plug socket 11*a*1 so that the slide block 2 may reciprocate, and the semi-circular slot 11*a*7 and the half pivot seat 21 may separate or couple to constitute movable pivot holes 3, as shown in FIG. 11. The two sides at the lower portion of the slide block 2 are each provided with a projecting post 23, and a spring 24 is mounted between each projecting post 23 and each stop block 11*a*8 of the lower casing 11*a*, such that the slide block 2 may slide outwardly by means of the springs 24. In addition, the front end of the inner side of the slide block is provided with a baffle piece 25, which is provided with a locking seat 26 at a rear side thereof (note FIG. 11). A locking block 7 is fitted on the slide slot 11*a*3 of the plug socket 11*a*1, the locking block 7 being laterally provided with an L-shaped strut 71 fitted with a spring 72 that may urge against the slot 11*a*4 of the plug socket 11*a*1, so that the upper portion of the locking block 7 may be fastened within the locking seat 26 of the slide block 2 to lock the slide block 2 in position. The slide block 2 may be released by pressing the locking block 7 downwardly, so that the slide block 2 may slide outwardly by means of the spring 72, while the resilient hooking plates 11*a*5 of the plug socket 2 may engage the baffle piece 25 of the slide block 2 to check the outward displacement of the slide block 2, as shown in FIG. 12.

Figure 13:
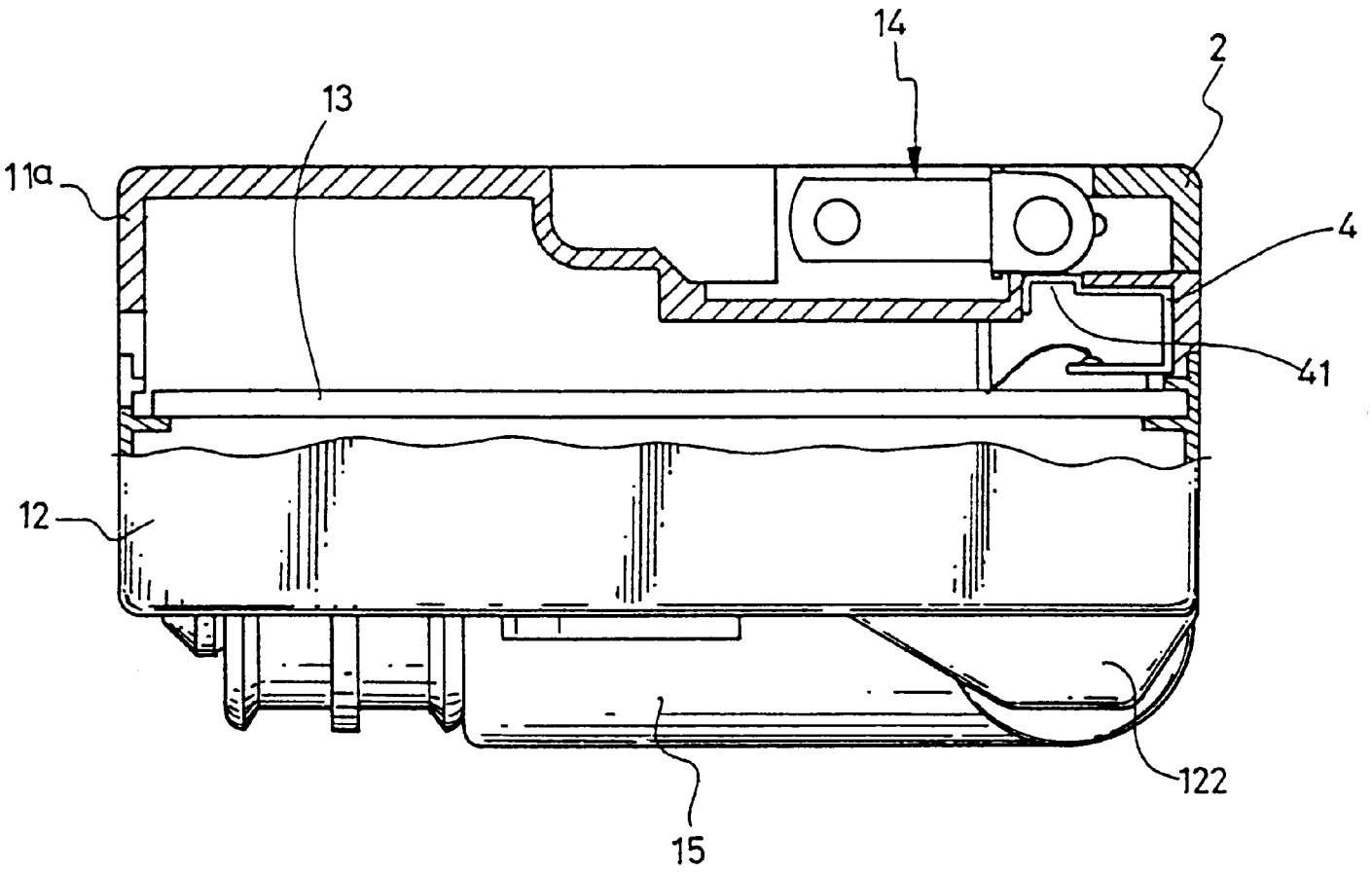
FIG. 13 is a sectional view of the mounting of the replaceable electrical plug and the conductive terminals of the preferred embodiment of the present invention.

By means of the structure as described in the above embodiment, the electrical plug 14 may be turned outwardly first before the locking block 7 is pressed downwardly so that it no longer urges against the locking seat 26 of the slide block 2. The slide block 2 may then slide outwardly due to the action of the springs 24. In this way, the half pivot seat 21 on the slide block 2 may disengage from the semi-circular slot 11*a*7, and the pivots 143 at both sides of the electrical plug 14 may be released, as shown in FIG. 12. Then, a suitable replaceable electrical plug 14 may be inserted by resting the pivots 143 of the electrical plug 14 against the semi-circular slots 11*a*7 at both sides of the lower casing 11*a*, and then pushing the slide block 2 toward the plug socket 11*a*1 so that the half pivot seats 21 at both sides rest on the pivots 143 and couple with the semi-circular slots 11*a*7. When the slide block 2 is pushed back, the locking block 7 will, due to the urging of the spring 72, engage the locking seat 26 in the slide block 2 to lock the slide block 2 in position, so that the electrical plug 14 is pivotally positioned in the movable pivot holes 3. The electrical plug 14 may then be turned outwardly so that two contact ends 144 at a rear side thereof respectively urge against the bent portions 41 of the two conductive terminals 4, as shown in FIG. 13.

Figure 14:
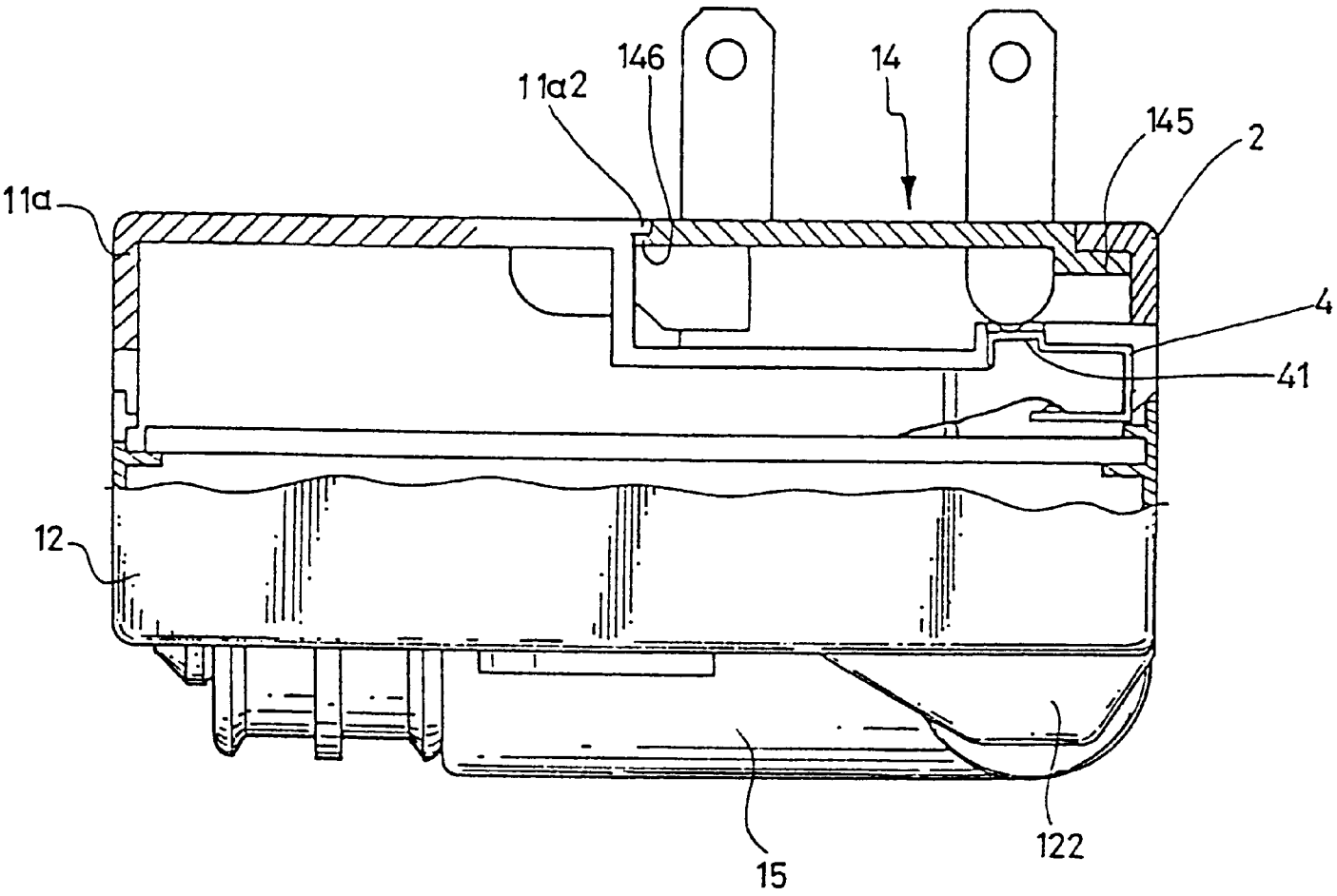
FIG. 14 is a sectional view illustrating replacement of an electrical plug of another specification.

With reference to FIG. 14, when mounting an electrical plug 14 with three legs 142, the positioning indentation 146 at the front end of the plastic plug body 141, may engage the projecting piece 11*a*2 in the plug socket 11*a*1, while the projecting piece 146 at the rear end may engage the front rim of the slide block 2 when the slide block 2 is being pushed back. The two contact terminals 144 at the rear end of the electrical plug 14 urge against the bent portions 141 of the two conductive terminals 4 so that the three-prong electrical plug 14 may be mounted in the plug socket 11*a*1 of the lower casing 11*a*. By means of this arrangement, the electrical plug 14 may be easily plugged in or removed.

Figure 16:
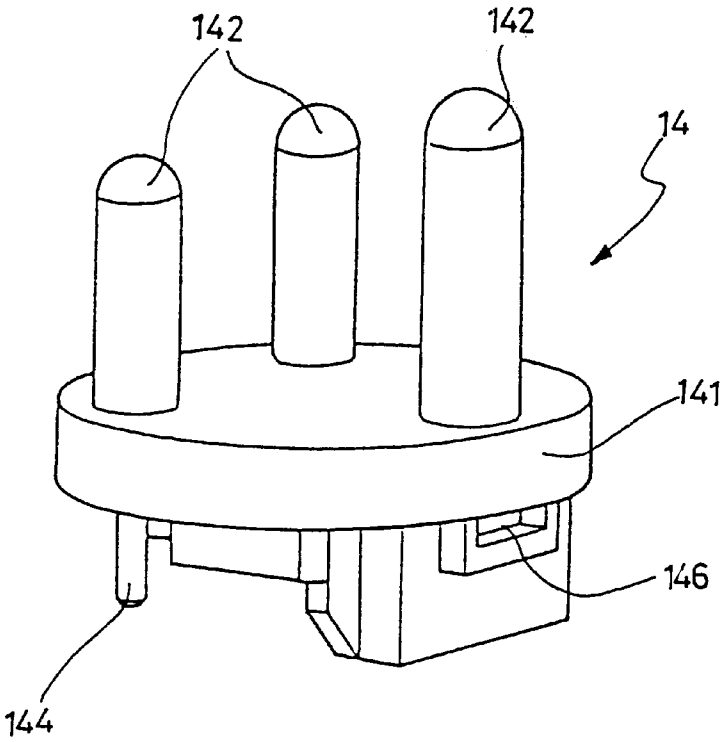
FIG. 16 is an elevational view of another example of the electrical plug.
Figure 15:
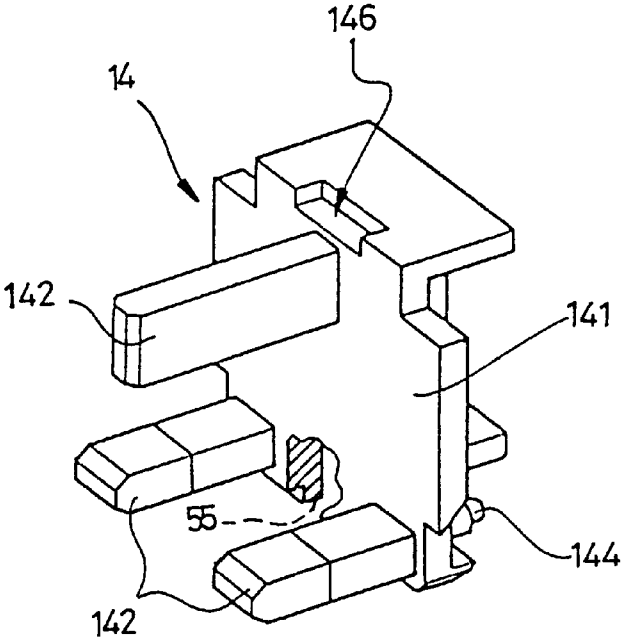
FIG. 15 is an elevational view of an example of the electrical plug.

Furthermore, the shape of the electrical plug 14 may be as that shown in FIG. 15 and that shown in FIG. 16.

Figure 18:
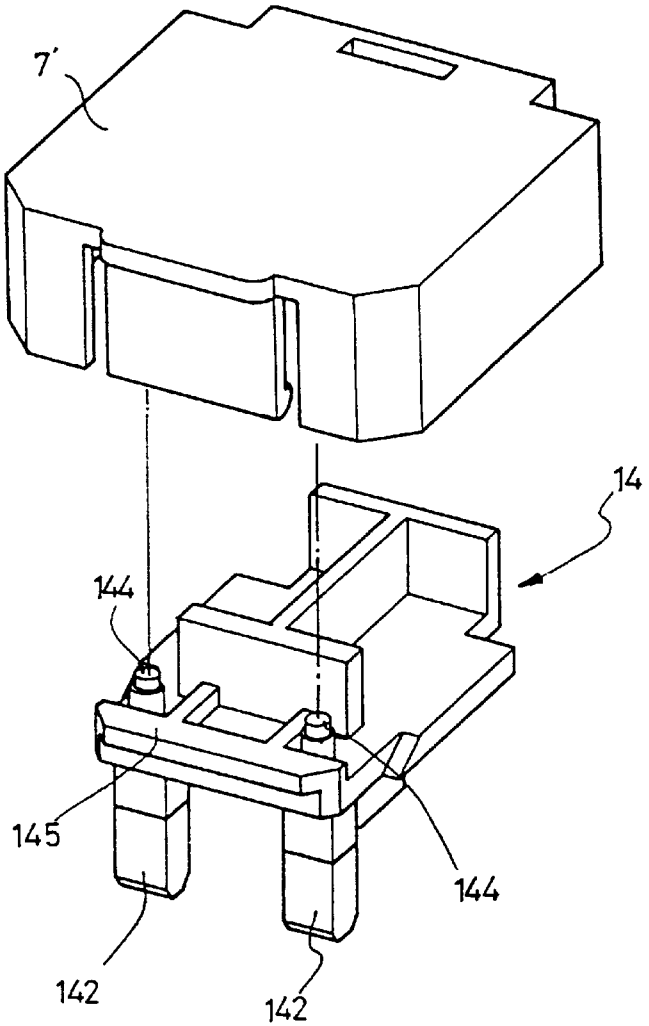
FIG. 18 is an elevational system diagram of a three-prong electrical plug fitted with a protective cover.
Figure 17:
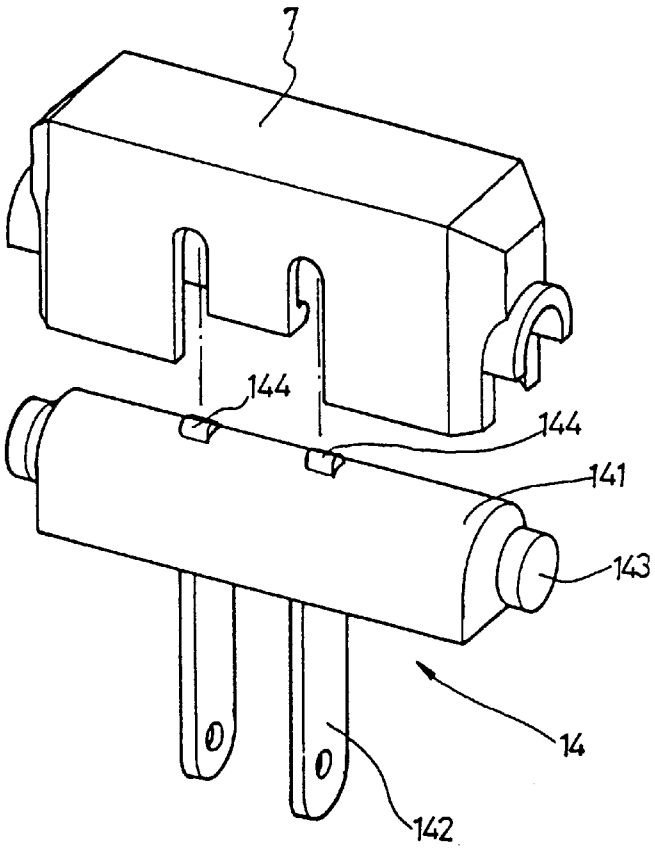
FIG. 17 is an elevational system diagram of the electrical plug fitted with a protective cover.

In addition, in order to prevent children from plugging the electrical plug 14 into the socket when the plug is not in use, a protective cover 7 may be provided at the rear end of the electrical plug 14 to conceal the contact ends 144 of the electrical plug 14 inside the protective cover 7, as shown in FIG. 17. Another embodiment of the protective cover 7' for three-prong electrical plugs 14 is shown in FIG. 18.

In summary, the present invention makes it possible to utilize cars' electric power as well as household electric power. The design of the replaceable electrical plug also makes it easy for travelers to utilize indoor electric power for recharging and other purposes.

Although the present invention has been illustrated and described with reference to the preferred embodiments thereof, it should be understood that it is in no way limited to the details of such embodiment, but it is capable of numerous modifications within the scope of the appended claims.

What is claimed is:

1. A charger with a replaceable electrical plug, comprising a casing (1) including a lower casing (11) and an upper casing (12), said casing (1) accommodating therein a power supply circuit (13) for lowering the voltage of a direct current and converting the voltage of an alternating current, said casing (1) being adopted for use with a plurality of replaceable electrical plugs (14) to match different specifications of electrical sockets, said casing (1) further having a cigarette lighter plug (15) disposed thereon for obtaining electric power of a car by fitting said cigarette lighter plug (15) into the car's cigarette lighter socket, wherein said lower casing (11) is provided with an opening (111) at a suitable position, a projecting seat (112) at a rear edge inside the opening (111), said projecting seat (112) being provided with a hole (1121) thereon, a slide groove (114) being provided inside said lower casing (11) to the rear of said projecting seat (112), said slide groove (114) being provided with an elongated slot (1141) therein and a stop block (1142) to the rear thereof, a movable fastening piece (115) and a positioning slide piece (116) being mounted above said slide groove (114), said movable fastening piece (115) having an elongated hole (1151) and said positioning slide piece (116) having a hole (1161), said movable fastening piece (115) being inserted into said hole (1121) of said projecting seat (112), a curved pivot seat (113) being disposed at either end of a front edge inside said opening (111), an inner casing (16) being secured inside said lower casing (11) corresponding to said opening (111), two slots (161) being provided on the surface of the front end of said inner casing (16), a curved notch (162) being disposed at either side wall of the front end of said inner casing (16), and a fastening seat (163) with a fastening hole (1631) being protrudently disposed at the middle of the rear end of said inner casing (11);

a slide seat (17) is fitted inside said inner casing (16) of said lower casing (11) such that it may reciprocate therein, an elastic fastening piece (172) being protrudently disposed at the middle of the rear end of said slide seat (17), and having a protrudent block (1721) thereon and a rod (1722) fitted thereon, said rod (1722) being inserted into said elongated hole (1151) of said movable fastening piece (115) and said hole (1161) of said positioning slide piece (116), as well as said elongated slot (1141) of said lower casing (11), such that, by means of pushing said rod (1722) inwardly to press said slide seat (17), said protrudent block (1721) of said elastic fastening piece (172) may engage said fastening hole (1631) of said inner casing (16), causing said movable fastening piece (115) to project outwardly to retract with the movement of said slide seat (17); either lateral side of the front end of said slide seat (17)

being provided with a half pivot seat (173) which may form a pivot hole (110) with said curved pivot seat (113) of said lower casing (11) and said curved notch (162) of said inner casing (16);

two electrically conductive pieces (18) disposed at the bottom of said inner casing (16), each of which having a bent portion (181) at the front end for matching said slot (161) of said inner casing (16), the rear end thereof being connected to said power supply circuit (13);

said replaceable electrical plug (14) includes a plug body (141) with a plurality of electrically conductive legs (142) for matching an electric socket, both sides of the rear end of said plug body (141) being respectively provided with a protrudent pivot (143) which may fit into the pivot hole (110) formed by said half pivot seat (173) of said slide seat (17), said curved pivot seat (113) of said lower casing (11) and said curved notch (162) of said inner casing (16), said legs (142) extending rearwardly to have two contact terminals (144) projecting from the rear edge of said plug body (141) such that said contact terminals (144) may contact said bent portions (181) of said two conductive pieces (18) when said electrical plug (14) is turned outwardly after assembly; and said upper casing (12) is provided with a recess (121) at a suitable position, a pair of pivot seats (122) each having a pivot hole (123) being disposed below said recess, a plurality of elastic arms (124) being disposed in said recess (121) at suitable positions, each of said elastic arms having a boss (1241); and said cigarette lighter plug (15) may be pivotally provided on said pivot seats (122), the bottom side of said cigarette lighter plug (15) being provided with an element (151) having a short pivot (152) provided at either side thereof and a plurality of depressions (153) on its peripheral surface, said short pivots (152) capable of fitting into said pivot holes (123) of said pivot seats (122) so that said cigarette lighter plug (15) may be pivotally mounted on said pivot seats (122) of said upper casing (12), and said bosses (1241) in said recess (121) may engage said depressions (153) of said element (151).

2. A charger with a replaceable electrical plug as claimed in claim 1, wherein said electrical plug (14) is a three-prong electrical plug and said plug body (141) is a structure having a protrudent piece (145) at a lower side thereof and a positioning indentation (146) at an upper side thereof such that said protrudent piece (145) may urge against the lower edge of said opening (111) of said lower casing (11) to push said rod (1722) of said slide seat (17) to displace outwardly and said movable fastening piece (115) to project outwardly to engage said positioning indentation (146) of said plug body (141) so that said electrical plug (14) may be replaced and secured in said opening (111) of said casing.

3. A charger with a replaceable electrical plug, comprising: a casing (1) including a lower casing (11*a*) and an upper casing (12), a slide block (2), two conductive terminals (144), and a replaceable electrical plug (14), said casing (1) accommodating therein an electronic power supply circuit (13) for lowering the voltage of a direct current and converting the voltage of an alternating current, said lower casing (11*a*) being adopted for use with a plurality of replaceable electrical plugs (14) to match different specifications of electrical sockets, and having a cigarette lighter plug (15) pivotally disposed thereon for obtaining electric power of a car by fitting said cigarette lighter plug (15) into the car's cigarette lighter socket, wherein said lower casing (11*a*) has a plug socket (11*a*1) provided thereon, an inner lateral side of said plug socket (11*a*1) being provided with a projecting piece (11*a*2), the middle of an outer lateral side of said plug socket (11*a*1) being with a slide groove (11*a*3), and a slot (11*a*4) is provided at an inner lateral side of said slide groove (11*a*3), a plurality of resilient hooking plates (11*a*5) being provided at the outer lateral side of said plug socket (11*a*1) at suitable positions, two guide slots (11*a*6) being respectively disposed at both sides of the outer lateral side of said plug socket (11*a*1), while a semi-circular slot (11*a*7) is disposed at each side of said plug socket (11*a*1) at a suitable position, a plurality of stop blocks (11*a*8) being provided at the inner lateral side of said lower casing (11*a*), and two mounting slots (11*a*9) are provided at said plug socket (11*a*1) for receiving a respective conductive terminal (4); and said slide block (2) is fitted at the outer lateral side of said plug socket (11*a*1), both sides of a front end of said slide block (2) being provided with half pivot seats (21) corresponding to said semi-circular slots (11*a*7), both sides of said slide block (2) being provided with guide blocks (22), which may fit into said guide slots (11*a*6) at both sides of said plug socket (11*a*1) so that said slide block (2) may reciprocate, and said semi-circular slot (11*a*7) and the half pivot seat (21) may separate or couple to constitute movable pivot holes (3), both sides of the lower portion of said slide block (2) being respectively provided with a projecting post (23), and a spring (24) being mounted between each projecting post (23) and each stop block (11*a*9) of said lower casing (11*a*), such that said slide block (2) may slide outwardly by means of said springs (24), the front end of the inner side of said slide block is provided with a baffle piece (25), which is provided with a locking seat (26) at a rear side thereof, a locking block (7) being fitted on said slide slot (11*a*3) of said plug socket (11*a*1), said locking block (7) being laterally provided with an L-shaped strut (71) fitted with a spring (72) that may urge against said slot (11*a*4) of said plug socket (11*a*1), so that the upper portion of said locking block (7) may be fastened within said locking seat (26) of said slide block (2) to lock said slide block (2) in position, said slide block (2) being released by pressing said locking block (7) downwardly, so that said slide block (2) may slide outwardly by means of said spring (72), while said resilient hooking plates (11*a*5) of said plug socket (2) may engage said baffle piece (25) of said slide block (2) to check the outward displacement of said slide block (2);

said two conductive terminals (4) are disposed in said mounting slots (11*a*9) of said plug socket (11*a*1) of said lower casing (11*a*) and are each provided with a bent portion (41) corresponding to said mounting slots (11*a*9), a rear end of each conductive terminal (4) being connected to said electronic power supply circuit (13);

said replaceable electric plug (14) is comprised of a plastic plug body (141) having a plurality of legs (142) corresponding to indoor electrical sockets, a rear end of said plastic plug body (141) having a pivot (143) at either end thereof, said pivots (143) being mounted in respective movable pivot holes (3) formed by said half pivot seats (21) of said slide block (2) and said semi-circular slots (11*a*7) of said lower casing (11*a*), said legs (142) extending rearwardly to project from the rear rim of said plastic plug body (141) to form two contact ends (144) which, after assembly, may contact said bent portions (41) of said two conductive terminals (4) when said electrical plug is turned outwardly.

4. A charger with a replaceable electrical plug as claimed in claim 3, wherein said replaceable electrical plug (14) is a three-prong electric plug, and said plastic plug body (141) is a plate-like structure having a flange at a lower portion and a positioning indentation (146) at an upper portion thereof, said indentation (146) engaging said projecting piece **(11*a*2) of said plug socket (11*a*1) of said lower casing (11*a*), while a projecting piece (145) at the rear end may engage the front rim of the inner side of said slide block (2) when said slide block (2) is being pushed back, said contact ends (144) at the rear end of said electrical plug (14) urging against said bent portions (41) of said conductive terminals (4) to enable said three-prong electrical plug to be mounted in said plug socket (11*a*1) of said lower casing (11*a*)**.

* * * * *